US006565205B2

(12) United States Patent
Shaw-Klein et al.

(10) Patent No.: US 6,565,205 B2
(45) **Date of Patent: *May 20, 2003**

(54) INK JET PRINTING METHOD

(75) Inventors: Lori J. Shaw-Klein, Rochester, NY (US); Alexandra D. Bermel, Pittsford, NY (US); Colin Martin, Ionia, NY (US)

(73) Assignee: Eastman Kodak Company, Rochester, NY (US)

( * ) Notice: Subject to any disclaimer, the term of this patent is extended or adjusted under 35 U.S.C. 154(b) by 151 days.

This patent is subject to a terminal disclaimer.

(21) Appl. No.: 09/799,932

(22) Filed: Mar. 6, 2001

(65) Prior Publication Data

US 2002/0171729 A1 Nov. 21, 2002

(51) Int. Cl.[7] ..... B41J 2/01
(52) U.S. Cl. ..... 347/105; 428/195
(58) Field of Search ..... 428/195, 323, 428/327, 500; 347/105, 106

(56) References Cited

U.S. PATENT DOCUMENTS 5,677,067 A * 10/1997 Kojima et al. ..... 428/478.2
6,338,891 B1 * 1/2002 Kawasaki et al. ..... 428/195
6,419,355 B1 * 7/2002 Bermel et al. ..... 347/105

FOREIGN PATENT DOCUMENTS

EP 1029702 A2 8/2000

* cited by examiner

*Primary Examiner*—Bruce H. Hess
*Assistant Examiner*—Michael Grendzynski
(74) *Attorney, Agent, or Firm*—Harold E. Cole; Paul A. Leipold

(57) ABSTRACT

An ink jet printing method, comprising the steps of:

A) providing an ink jet printer that is responsive to digital data signals;

B) loading the printer with an inkjet recording element comprising a support having thereon a porous image-receiving layer comprising particles in a binder, the particles having a primary particle size of from about 7 to about 40 nm in diameter which may be aggregated up to about 300 nm, the image-receiving layer being coated from an acidic aqueous dispersion, and the recording element containing a subbing layer between the support and the porous image-receiving layer, the subbing layer comprising a basic material which is capable of raising the surface pH of the image-receiving layer at least about 2 pH units;

C) loading the printer with an ink jet ink composition; and

D) printing on the image-receiving layer using the ink jet ink composition in response to the digital data signals.

16 Claims, No Drawings

INK JET PRINTING METHOD

CROSS REFERENCE TO RELATED APPLICATION

Reference is made to commonly assigned, co-pending U.S. patent application Ser. No. 09/799,933 by Shaw-Klein et al., filed of even date herewith entitled "Ink Jet Recording Element".

FIELD OF THE INVENTION

The present invention relates to an ink jet printing method using a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

EP 1,029,702 discloses an ink jet recording element comprising a support having thereon a gelatin subbing layer and a coating dispersion of silica and PVA. However, there is a problem with this element in that the gloss is lower than one would like.

It is an object of this invention to provide an ink jet printing method using a porous ink jet recording element that, when printed with dye-based inks, provides better hues and higher gloss. It is another object of this invention to provide an ink jet printing method using a porous ink jet recording element that has an acid-free surface, which is desirable for archival printing applications.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an ink jet recording element comprising a support having thereon a porous image-receiving layer comprising particles in a binder, the particles having a primary particle size of from about 7 to about 40 nm in diameter which may be aggregated up to about 300 nm, the image-receiving layer being coated from an acidic aqueous dispersion, and the recording element containing a subbing layer between the support and the porous image-receiving layer, the subbing layer comprising a basic material which is capable of raising the surface pH of the image-receiving layer at least about 2 pH units;

C) loading the printer with an ink jet ink composition; and

D) printing on the image-receiving layer using the ink jet ink composition in response to the digital data signals.

Better hues and a higher gloss are obtained by printing on a porous ink jet recording element with dye-based inks in accordance with the invention.

DETAILED DESCRIPTION OF THE INVENTION

The ink-receiving layer employed in the invention contains particles so that the layer is porous in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small that they do not scatter visible light.

The particles may be in the form of primary particles or in the form of secondary aggregated particles. The aggregates are comprised of smaller primary particles about 7 to about 40 nm in diameter, and being aggregated up to about 300 nm in diameter. The pores in a dried coating of such aggregates fall within the range necessary to ensure low optical scatter yet have sufficient ink solvent uptake. The particles useful in the invention may be inorganic or organic and may be manufactured by various methods and are commercially available for an image-receiving layer.

Examples of particles useful in the invention include alumina, boehmite, clay, calcium carbonate, titanium dioxide, calcined clay, alumino-silicates, silica, barium sulfate, or polymeric beads. The particles may be porous or nonporous. In a preferred embodiment of the invention, the particles are metallic oxides such as alumina, boehmite or cationically-modified silica. Such particles are preferred because they possess cationic surfaces, which are capable of binding anionic ink jet printing dyes, rendering printed images resistant to dye migration due to water and high humidity conditions. Such particles are considered to possess a cationic charge in aqueous dispersions if the pH of the dispersion is maintained below the particle point of zero charge. The point of zero charge of such particles is above pH 7, so that stable dispersions of such particles are maintained under acidic conditions. For example, stable aqueous dispersions of fumed alumina generally possess a pH of around 4 or lower.

In a preferred embodiment of the invention, the image-receiving layer is coated from an acidic aqueous dispersion having a pH below about 5, more preferably at a pH below about 4.

Any basic material may be used in the subbing layer employed in the invention as long as it is compatible with the subbing layer polymer. In a preferred embodiment, the basic material comprises sodium hydroxide or triethanolamine. In another preferred embodiment, the basic material is capable of raising the surface pH of the image-receiving layer at least above about 4.

In yet another preferred embodiment of the invention, the subbing layer comprises a mixture of a basic material and a polymer. Any polymer may be used in this layer, as long as it is compatible with the basic material. For example, gelatin, poly(vinyl alcohol) or an acrylic latex polymer may be used.

While any amount of basic material may be used in the subbing layer, in general, the subbing layer comprises from about 10–30% by weight of the basic material.

In a preferred embodiment of the invention, the binder in the image-receiving layer is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly (acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, gelatin, or a poly(alkylene oxide). In yet still another preferred embodiment, the hydrophilic binder is poly(vinyl alcohol). The binder should be chosen so that it is compatible with the aforementioned particles.

The amount of binder used should be sufficient to impart cohesive strength to the ink jet recording element, but should also be minimized so that the interconnected pore structure formed by the aggregates is not filled in by the binder. In a preferred embodiment of the invention, the weight ratio of the binder to the total amount of particles is from about 1:20 to about 1:5.

Since the image-receiving layer is a porous layer comprising particles, the void volume must be sufficient to absorb all of the printing ink. For example, if a porous layer has 60 volume % open pores, in order to instantly absorb 32 $cc/M^2$ of ink, it must have a physical thickness of at least about 54 $\mu$m.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates, polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the image-receiving layer and an overcoat layer may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated so that the total solids content will yield a useful coating thickness, and for particulate coating formulations, solids contents from 10–60% are typical.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following example is provided to illustrate the invention.

EXAMPLE

Element 1 of the Invention

A basic subbing layer was prepared by combining lime-process ossein photographic grade gelatin (Eastman Gelatine) and sodium hydroxide (Aldrich Chemical Co.) in a ratio of 4.3:1 to give an aqueous coating solution of 3% solids. The above coating solution was bead-coated at 40° C. on a polyethylene-coated paper base which had been previously subjected to a corona discharge treatment. The coating was then dried at 60° C. by forced air to yield a basic subbing layer having a thickness of about 1.5 $\mu$m, or a dry coating weight of 1.6 g/m$^2$.

The ink jet receiving layers were prepared as follows: A coating solution for a bottom ink absorbing layer was prepared by combining fumed alumina (Cab-O-Sperse® PG003, Cabot Corp.), poly(vinyl alcohol) (Gohsenol® GH-23A, Nippon Gohsei Co., Ltd.) and 2,3-dihydroxy-1,4-dioxane (Clariant Corp.) in a ratio of 88:10:2 to give an aqueous coating formulation of 30% solids by weight.

A coating solution for an overcoat layer was prepared by combining fumed alumina (Cab-O-Sperse® PG003, Cabot Corp.), poly(vinyl alcohol) (Gohsenol® GH-23A, Nippon Gohsei Co.) and a copolymer of (vinylbenzyl)trimethylammonium chloride and divinylbenzene (87:13 molar ratio) in a ratio of 85:3:12 to give an aqueous coating formulation of 10% solids by weight. Surfactants Zonyl® FSN (E. I. du Pont de Nemours and Co.) and Olin® 10G (Dixie Chemical Co.) were added in small amounts as coating aids.

The above coating solutions were simultaneously bead-coated at 40° C. on the basic subbing layer described above. The overcoat layer was coated on top of the bottom ink-absorbing layer. The coating was then dried at 60° C. by forced air to yield a two-layer recording element in which the thicknesses of the bottom and topmost layers were 40 $\mu$m (43 g/m$^2$) and 2 $\mu$m (2.2 g/m$^2$), respectively.

Element 2 of the Invention

Element 2 was prepared the same as Element 1 except that the basic subbing layer comprised a combination of poly (vinyl alcohol) (Gohsenol® GH-23A, Nippon Gohsei Co.) and triethanolamine in a ratio of 4.3:1.

Element 3 of the Invention

Element 3 was prepared the same as Element 1 except that the basic subbing layer comprised a combination of an acrylic latex (Neocryl® A622, Zeneca Resins) and sodium hydroxide in a ratio of 4.3:1.

Control Element 1

This element was prepared the same as Element 1 except that no basic subbing layer was coated.

Control Element 2

This element was prepared the same as Element 1 except that the subbing layer comprised only gelatin. No basic material was added.

Control Element 3

This element was prepared the same as Control Element 1 except that sodium hydroxide was added to the overcoat coating solution during the bead coating process by simultaneously adding an aqueous solution of sodium hydroxide into the top slot of the coating hopper. A dried coating could not be obtained due to severe flocculation of the coating melt before it could be successfully deposited onto the support.

Control Element 4

For reference, a commercially available inkjet receiver was used. (Epson® Professional Media Photo Glossy Paper, catalog number SP91001).

Coating Quality

The dried coatings were evaluated visually for surface appearance, primarily cracking. The gloss of each coating was measured at angles of 20 and 60 degrees from the perpendicular to the coating surface using a BYK Gardner microgloss meter. The surface pH of each dried coating was measured using a conventional surface pH marking pencil (pHydrion Insta-chek® Gardco Co.). The following results were obtained:

TABLE 1

| Recording Element | Appearance | 20 degree gloss | 60 degree gloss | pH |
|---|---|---|---|---|
| 1 | Fair | 32 | 68 | 4.5 |
| 2 | Excellent | 34 | 71 | 4.0 |
| 3 | Fair | 32 | 69 | 5.0 |
| C-1 | Excellent | 32 | 68 | 2.0 |
| C-2 | Severely cracked | 2 | 9 | 2.5 |
| C-4 | Excellent | 13 | 32 | 5.0 |

The above results show that the surface pH of the coating of the Elements employed in the invention was raised from the level of C-1 while maintaining high gloss and having an acceptable appearance. In contrast thereto, C-2 was severely cracked and had low gloss while C-4 also had low gloss.

Density Testing

Test images of a cyan patch at 100% ink laydown were printed using an Epson Stylus® Photo 870 using inks with catalogue number T008201.

After drying for 24 hours at ambient temperature and humidity, the colorimetry of the cyan patch was measured using a Minolta colorimeter. The a* and b* values describe the hue of the patch. More negative a* values represent a more green hue, while more negative b* values represent more blue color. The following results were obtained:

TABLE 2

| Recording Element | a* | b* |
|---|---|---|
| 1 | −26.37 | −57.76 |
| 2 | −30.81 | −52.77 |
| 3 | −26.62 | −57.17 |
| C–1 | −36.59 | −46.38 |
| C–4 | −34.61 | −56.26 |

The above results show that the cyan patch appears bluer (b* values more negative) for the recording elements employed in the invention as compared to C-1 which was not pH adjusted. (C-4 has an acceptable blueness which was used as a standard).

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method, comprising the steps of:

A) providing an ink jet printer that is responsive to digital data signals;

B) loading said printer with an ink jet recording element comprising a support having thereon a porous image-receiving layer comprising particles in a binder, said particles having a primary particle size of from about 7 to about 40 nm in diameter which may be aggregated up to about 300 nm, said image-receiving layer having been coated from an acidic aqueous dispersion, and said recording element containing a subbing layer between said support and said porous image-receiving layer, said subbing layer comprising a basic material which raised the surface pH of said image-receiving layer at least 2 pH units;

C) loading said printer with an ink jet ink composition; and

D) printing on said image-receiving layer using said ink jet ink composition in response to said digital data signals.

2. The method of claim 1 wherein said image-receiving layer being coated from an acidic aqueous dispersion having a pH below about 5.

3. The method of claim 1 wherein said image-receiving layer being coated from an acidic aqueous dispersion having a pH below about 4.

4. The method of claim 1 wherein said basic material is capable of raising the surface pH of said image-receiving layer at least above 4.

5. The method of claim 1 wherein said subbing layer comprises a mixture of a polymer and said basic material.

6. The method of claim 5 wherein said polymer is gelatin, poly(vinyl alcohol) or an acrylic latex polymer.

7. The method of claim 5 wherein said basic material comprises sodium hydroxide or triethanolamine.

8. The method of claim 1 wherein said subbing layer comprises from about 10–30% by weight of said basic material.

9. The method of claim 1 wherein the weight ratio of said binder to said particles in said image-receiving layer is from about 1:20 to about 1:5.

10. The method of claim 1 wherein said binder is a hydrophilic polymer.

11. The method of claim 10 wherein said hydrophilic polymer is poly(vinyl alcohol), hydroxypropyl cellulose, hydroxypropyl methyl cellulose, gelatin or a poly(alkylene oxide).

12. The method of claim 1 wherein said polymeric binder is poly(vinyl alcohol).

13. The method of claim 1 wherein said particles are metallic oxides.

14. The method of claim 1 wherein said particles are alumina, boehmite or cationically-modified silica.

15. The method of claim 1 wherein said image-receiving layer also contains a mordant.

16. The method of claim 1 wherein said support is polyethylene-coated paper.

* * * * *